United States Patent [19]

Elsner

[11] 4,279,407

[45] Jul. 21, 1981

[54] METALLURGICAL FURNACE IN PARTICULAR AN ELECTRIC ARC FURNACE

[75] Inventor: Emil Elsner, Baden-Baden, Fed. Rep. of Germany

[73] Assignee: Korf-Stahl AG, Fed. Rep. of Germany

[21] Appl. No.: 155,925

[22] Filed: Jun. 3, 1980

[30] Foreign Application Priority Data

Jun. 20, 1979 [DE] Fed. Rep. of Germany ..... 2924860

[51] Int. Cl.[3] ..... C21B 7/10; H05B 7/18

[52] U.S. Cl. ..... 266/193; 13/9 R

[58] Field of Search ..... 266/193; 13/9

[56] References Cited

U.S. PATENT DOCUMENTS

| | | | |
|---|---|---|---|
| 3,705,713 | 12/1972 | Wirtz | 266/193 |
| 4,029,053 | 6/1977 | Higuchi | 266/193 |
| 4,150,818 | 4/1979 | Buhler | 266/193 |

*Primary Examiner*—P. D. Rosenberg

[57] ABSTRACT

An electric metallurgical furnace in which at least one row of the bricks that adjoin the annular flange the outer edge is displaced outwardly with respect to that of the bricks and the rows adjoining the annular flange are pressed by the flange on to the rows below.

10 Claims, 3 Drawing Figures

Figure 1:
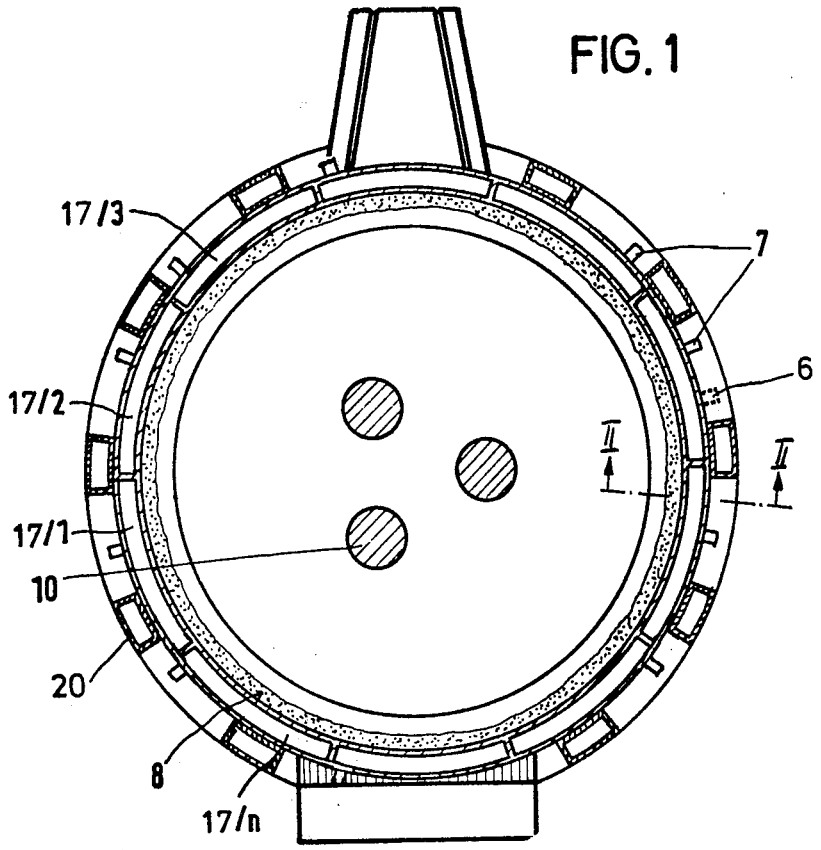

17/3
7
6
17/2
II
II
17/1
10
20
8
17/n

METALLURGICAL FURNACE IN PARTICULAR AN ELECTRIC ARC FURNACE

The invention relates to a metallurgical furnace, in particular an electric arc furnace.

A furnace of this kind is disclosed in DAS No 26 31 982 or DOS No 28 24 821. In furnaces of this kind, the masonry in the upper region of the wall is replaced by an annular water cooling box or water cooling boxes which are in the form of segments of a ring, and which are protected on the side which faces towards the interior of the furnace, by a layer of refractory material. Leakage water which runs out into the shrinkage gap between the water cooling boxes and the refractory protective coating is collected by the annular flange which is of a suitable configuration for this purpose, below the water cooling box, and conducted outwardly. In order to be able better to perform this function and in order to increase the volume of the furnace, the wall of the water cooling box or boxes, which is towards the interior of the furnace, is displaced outwardly with respect to the inside wall surface, which is towards the interior of the furnace, of the refractory bricks or blocks which are disposed at a lower level.

It has been found that, when using water cooling boxes which are displaced outwardly for the above-indicated reasons, the refractory bricks or blocks of the rows which are disposed below and adjoining the water cooling boxes can no longer be held in position and cooled to the desired extent, so that increased wear and, frequently, failure of bricks, occurs at that point. This has been found to happen particularly in a furnace in which the water cooling boxes are displaced outwardly at least to such an extent that their wall surface which faces inwardly of the furnace is approximately aligned with the outside wall surface of the bottom vessel portion of the furnace, which is disposed at a lower level.

An object of the present invention, in a furnace of the above-indicated kind, is to ensure good keying or anchoring of the rows of refractory bricks or blocks, which are disposed below and adjoining the water cooling box. At the same time, the invention seeks to permit heat to be conducted away from the bricks or blocks by way of the keying.

In the structure according to the present invention, the upper rows of bricks or blocks are either displaced outwardly or are extended in the radial direction of the furnace so that they can be held in position or keyed by the annular flange which serves to collect and carry away leakage water. This not only provides an improved anchoring action in respect of the bricks, but also substantially improves the heat transfer between the bricks and from the uppermost row of bricks to the annular flange. By virtue of water cooling of the annular flange and a reinforcing structure which adjoins the annular flange therebelow, the upper rows of bricks or blocks can also be cooled to such a good extent that the amount of wear is substantially reduced.

Figure 2:
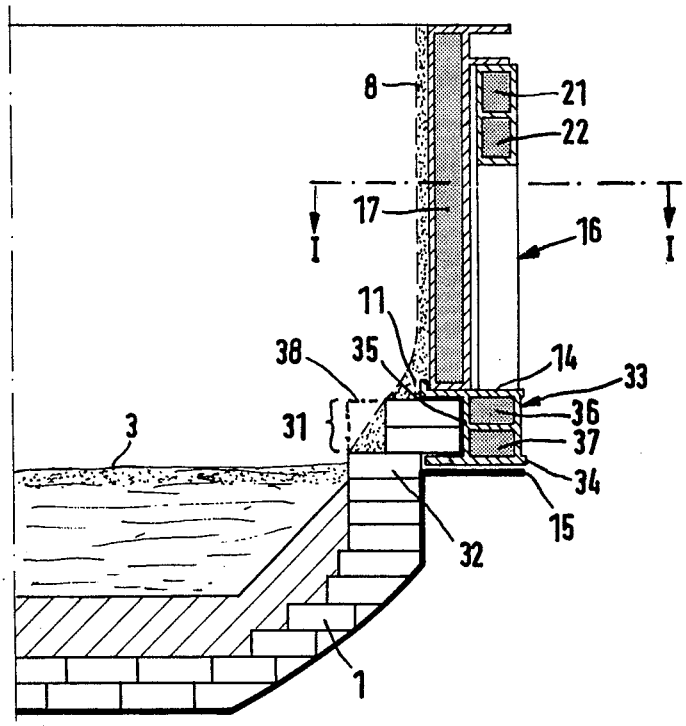
Figure 3:
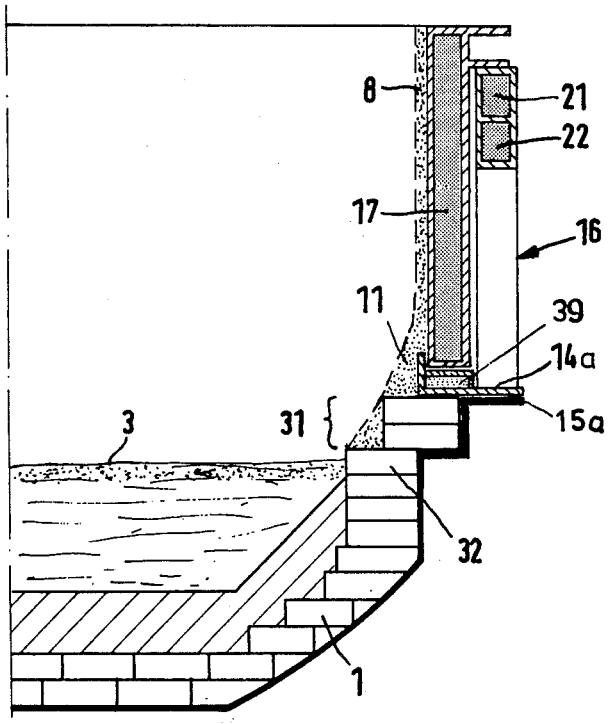

The invention is described in greater detail hereinafter by means of two embodiments, with reference to three figures of drawings in which:

FIG. 1 shows a view of a furnace according to the invention in radial section along line I—I in FIG. 2, FIG. 2 shows a view in section taken along line II—II in FIG. 1, and FIG. 3 shows a view of a further embodiment in cross-section corresponding to FIG. 2.

The furnace vessel of an electric arc furnace, which is shown in diagrammatic form in radial section in FIGS. 1 and 2, with part in axial section, includes a tub-like or trough-like bottom vessel 1 of refractory bricks, and, at a height which is above the maximum level 3 of molten material, a multiplicity of water cooling boxes 17/1, 17/2 . . . 17/n which are in the form of sectors of a hollow ring and which are each provided with connecting means 6 and 7 for the separate supply of cooling water from the ring conduits 21 and 22 shown in FIG. 2. Of the connecting means 6 which are disposed above the cross-sectional plane shown in FIG. 1, only one such connecting means 6 is indicated in broken line. The surface of the water cooling boxes, which faces inwardly of the furnace, is provided with projections (not shown) which on the one hand hold in position a refractory material 8 which is applied thereto beforehand and which on the other hand collect splashes or spatters of slag or dross which run down in the event of local damage to the refractory material, in order thereby to re-form a refractory protective layer. In order to ensure, when water issues from the water cooling boxes, that the water cannot penetrate into the region of the molten bath, the construction has a flange 14 which is of a channel-like configuration, as shown in FIG. 2; in addition, the wall of the water cooling boxes 17, which faces inwardly of the furnace, is displaced outwardly with respect to the inside wall surface of the bottom vessel portion 1 of the furnace, which is at a lower level. In the embodiment illustrated, the inside wall of the water cooling boxes is displaced outwardly to such an extent that it is approximately aligned with the outside wall surface of the furnace vessel disposed therebelow. In the event of a leak on the side of the water cooling boxes which faces inwardly of the furnace, the water which flows down below the refractory material 8 and which would wet the cladding of the bottom vessel portion and which would result in the danger of an explosion is collected by the channel-like flange 14 and conducted outwardly. The flange is protected from the direct effect of heat, by refractory material 11. The electrodes of the electric arc furnace are denoted by reference numeral 10 in FIG. 1.

In order to provide a better anchoring action and in order to improve the cooling effect, in the furnace of this kind, the top two rows 31 of the refractory bricks are displaced outwardly and are pressed by the annular flange 14 on to the rows 32 therebelow of refractory bricks. For this purpose, the annular flange 14 must overlap the row 31 of bricks by a certain minimum dimension and it is also necessary to ensure that there is a sufficient bearing area in respect of the row 31 of bricks on the row 32. The rows of bricks are held in position by the annular flange 14, and they can also be keyed in place by further bricks. This not only ensures a good anchoring action in respect of the rows 31 of bricks and also the rows 32 therebelow, but also improves the transfer of heat to the annular flange. Instead of displacing the rows 31 of bricks outwardly, in those rows the bricks can also be extended in the radial direction of the furnace, as shown in broken lines at 38 in FIG. 2. The important factor is that the outer edge of the rows 31 which adjoin the annular flange 14 is displaced outwardly with respect to the outer edge of the rows 32 of bricks therebelow.

In the illustrated preferred embodiment of the invention, the annular flange 14 is part of a cage-like support structure 16, which is supported on a support flange 15 of the bottom vessel portion of the furnace, for supporting the water cooling boxes 17 which are in the form of sectors of a hollow ring. The annular flange 14 is also stiffened by a reinforcing structure 33. In the embodiment illustrated, the reinforcing structure is in the form of a box profile which is delimited partly by the annular flange 14 and partly by an annular flange 34 which, like the annular flange 14, also projects towards the interior of the furnace, thus forming a U-shaped member 35 which accommodates the rows 31 of bricks. The box profile 33 includes cooling water passages 36 and 37, thereby ensuring good cooling for the annular flange 14 and the entire reinforcing structure of the annular flange. As the rows 31 of bricks are fixedly gripped in the reinforcing structure and adjoin the water-carrier passages, this arrangement provides for very good cooling of the rows 31 of bricks, in particular if the bricks comprise refractory material of good heat conductivity such as carbon magnesite or graphite. This means that the amount of wear of such bricks can be substantially reduced.

As, in the preferred embodiment shown in FIG. 2, the rows 31 of bricks are held within a U-shaped configuration, these rows of bricks can be associated with the support structure 16, in the manufacture of the furnace wall, that is to say, the support structure for the water cooling boxes can be pre-fabricated with rows 31 of bricks already installed and keyed therein, and can then be fitted on to the rows 32 of bricks of the bottom vessel portion of the furnace. This makes it possible to arrive at the optimum conditions in regard to the rows 31 of bricks being gripped in position and in regard to the transfer of heat to the annular flange 14 and to the reinforcing structure of the annular flange.

Instead of bricks such as carbon magnesite bricks which have a good level of heat conductivity, it is also possible to use blocks such as graphite blocks to form the rows 31. Generally, the number of rows of bricks or blocks will be between 1 and 4.

The embodiment described above was described with reference to an electric arc furnace as the arrangement according to the invention is of particular significance in that connection, due to the high loadings produced by the electric arcs. However, the features of the invention can be used generally in metallurgical furnaces, in particular in hearth-type furnaces.

In the construction shown in FIG. 3, a cooling water passage 39 is associated with the limb, which adjoins the row 31 of bricks, of the angular flange 14*a*. The flange 14*a* is pressed downwardly against the row 31 of bricks either by way of the support structure 16 or by being clamped together with the support flange 15*a* by way of fixing means (not shown), thereby providing for intensive cooling of the bricks of the row 31. Water cooling passages 36 and 37 as shown in FIG. 2 can additionally be provided.

I claim:

1. A metallurgical furnace having a wall lining comprising rows, which are disposed one above the other, of refractory bricks in a lower region thereof and at least one water cooling box in an upper region of the wall, the water cooling box being displaced outwardly with respect to the inside wall surface of the bricks, which is towards the interior of the furnace, and also having an annular flange between the water cooling box and the bricks for receiving and conducting outwardly leakage water from the water cooling box, characterized in that, at least in respect of one row of the bricks which adjoin the annular flange, the outer edge is displaced outwardly with respect to that of the bricks therebelow, and the rows adjoining the annular flange are pressed by the flange on to the rows therebelow.

2. A furnace according to claim 1 characterised in that the annular flange is part of a cage-like support structure for the water cooling box, the support structure being supported on a bottom vessel portion of the furnace, and the annular flange itself is reinforced by a reinforcing structure.

3. A furnace according to claim 2 characterised in that the reinforcing structure includes at least one perpendicular reinforcing rib which extends in the peripheral direction of the furnace and which adjoins the row of bricks, whose outer edge is displaced outwardly.

4. A furnace according to claim 2 or claim 3 characterised in that the row of bricks whose outer edge is displaced outwardly is held within a U-shaped member which is partly formed by the annular flange.

5. A furnace according to one of claims 2 or 3 characterised in that the reinforcing structure is provided by a box profile which is partly formed by the annular flange.

6. A furnace according to claim 1 characterised in that cooling water passages are associated with the annular flange and a reinforcing structure provided for the annular flange.

7. A furnace according to claim 5 characterised in that the box profile contains the cooling water passages.

8. A furnace according to one of claims 1, 3 or 6 characterised in that the row of bricks whose outer edge is displaced outwardly are of greater length, in the radial direction of the furnace, than the bricks therebelow.

9. A furnace according to one of claims 1 to 3 or 6 characterized in that the material for the bricks whose outer edge is displaced outwardly is a refractory material which has good heat conductivity.

10. A furnace according to one of claims 1 to 3 characterised in that the cross-section of the annular flange is of an angular configuration and a cooling water passage is associated at least with a limb portion which adjoins the row of bricks.

* * * * *